United States Patent [19]

Kuehnle

[11] 3,951,541

[45] Apr. 20, 1976

[54] DUPLICATOR PROCESSOR

[75] Inventor: Manfred R. Kuehnle, Lexington, Mass.

[73] Assignee: Coulter Information Systems, Inc., Bedford, Mass.

[22] Filed: Sept. 14, 1973

[21] Appl. No.: 397,310

[52] U.S. Cl. ..... 355/8; 355/10; 355/14; 355/16; 355/27; 355/50

[51] Int. Cl.[2] ..... G03G 15/28; G03G 15/32

[58] Field of Search ..... 355/3, 17, 8, 10, 14, 355/16, 27, 50

[56] References Cited

UNITED STATES PATENTS

| | | | |
|---|---|---|---|
| 3,168,857 | 2/1965 | Hutto | 355/5 |
| 3,196,765 | 7/1965 | Walkup | 355/5 |
| 3,408,144 | 10/1968 | Cowan | 355/48 |
| 3,597,063 | 8/1971 | Hayashi et al. | 355/16 X |
| 3,598,489 | 8/1971 | Thomas | 355/51 |
| 3,698,807 | 10/1972 | Weigl | 355/8 |
| 3,711,198 | 1/1973 | Nordine | 355/51 |
| 3,724,941 | 4/1973 | Honjo | 355/3 |
| 3,748,034 | 7/1973 | Luebbe | 355/16 X |

*Primary Examiner*—John F. Gonzales
*Attorney, Agent, or Firm*—Silverman & Cass, Ltd.

[57] ABSTRACT

Strip film of the conventional silver halide emulsion type is duplicated by optically projecting the images onto a high speed electrophotographic film in a system comprising a flow type camera having the original film and the electrophotographic film travelling at the identical film speed. The first station for the electrophotographic film is a charging station, followed by the projection slit, a toning station and a toner fixing station.

The background density of the original film is measured by photometric means and compared with preset density standards, the resulting information being used to enhance the image produced on the electrophotographic film by varying the charge voltage level. Charge level will control the amount of toner which adheres for a given time of toning.

11 Claims, 1 Drawing Figure

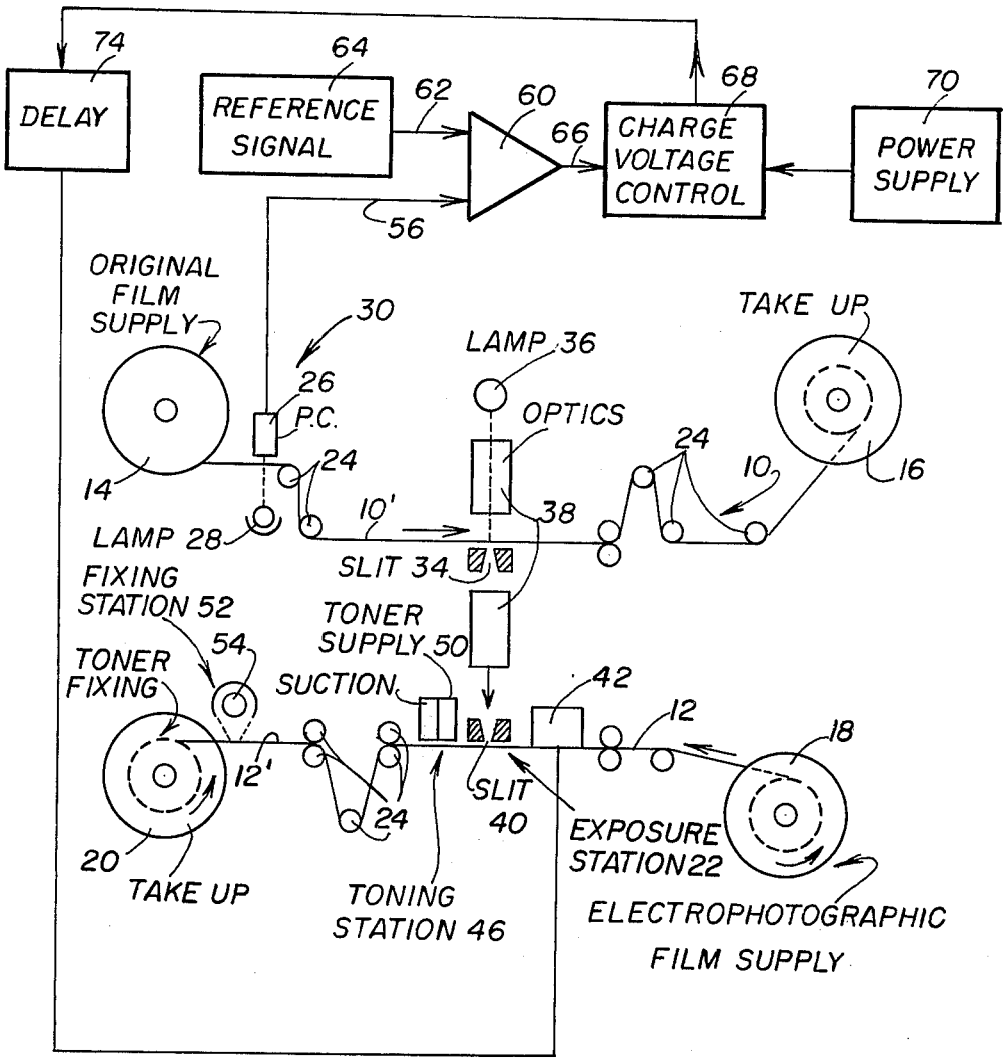
74
DELAY
64
REFERENCE SIGNAL
62
60
66
68
CHARGE VOLTAGE CONTROL
70
POWER SUPPLY
56
ORIGINAL FILM SUPPLY
30
26
P.C.
14
24
LAMP 28
10'
LAMP 36
OPTICS
38
SLIT 34
TAKE UP
24
10
16
FIXING STATION 52
54
TONER FIXING
TONER SUPPLY 50
SUCTION
42
12
18
12'
24
SLIT 40
EXPOSURE STATION 22
20
TAKE UP
TONING STATION 46
ELECTROPHOTOGRAPHIC FILM SUPPLY

DUPLICATOR PROCESSOR

CROSS-REFERENCE TO RELATED APPLICATION

Reference will be made herein to a copending application Ser. No. 378,180 filed July 11, 1973 and entitled "ELECTROPHOTOGRAPHIC FILM, METHOD OF MAKING AND USING THE SAME AND PHOTOCONDUCTIVE COATING USED THEREWITH" for the details of the electrophotographic film preferably used with the invention.

BACKGROUND OF THE INVENTION

The invention herein relates to the duplicating of strip film and specifically is directed to a method and apparatus for duplicating positive film of the silver halide type on a much more economical type of electrophotographic film.

The duplicating of strip film is principally practiced in the cinema field where multiple copies of a master are made. The basic technique in such duplication of using a flow type camera is also utilized in the invention. All film for taking systems in use today is silver halide film which is expensive and which, in cases where large quantities of film are retained, ties up great stores of silver, a scarce metal. For example, aside from use in the cinema field, there are vast accumulations of exposed silver halide film held in information storage and retrieval systems.

Xerographic and electrofacsimile apparatus and techniques are well-known. In these processes, a photoconductive coating on an ohmic surface is charged by corona or the like, is exposed to the image of a scene and is toned so that the latent charge image becomes visible. In the electrofacsimile (electrofax) process, the toned image is fixed directly onto the photoconductive coating. The most familiar one of these is the zinc oxide-resin coating on a sheet of conductive paper. This produces a copy of the image on an opaque sheet. The electrophotographic members of known electrostatic processes are notoriously slow. It has never been practical, so far as known, to make copies from photographic silver halide film onto these prior art members because of their low photographic speed. Additionally, the resolution and grey scale of prior art electrostatic copies are so inferior to those of conventional photographic film that it is impractical if not impossible to reproduce comparable photographic images on xerographic or electrofax members.

The advent of the electrophotographic film of the copending application makes reproduction of images from conventional photographic film onto electrostatic members feasible and highly economical, the duplication thus enabling the salvage of the silver halide film and the recovery of the silver therefrom. Such electrophotographic film is a highly flexible, high speed, high resolution material with a hard and abrasion resistant surface. Its other attributes are fully detailed in the said copending application.

In the duplication of film in the cinema art, where a copy of a master is being made, the technique of image enhancement is practiced. The master is carefully edited and the editor prepares a program of image enhancement which involves generally the variation in the amount of light used to project the image from the master onto the copy film. In other words, the editor chooses the proper exposure for the film as it is being duplicated to provide the optimum film density for viewing. According to the invention this is accomplished automatically. The advantages are manifold since the speed of the flow type camera need not be decreased and there is no need for pre-editing the film.

The method and structure for automatic image enhancement operate on the charging means for the electrophotographic film, which in effect involves varying the tonability of the film. There is no parallel or equivalent of this in conventional photographic film whose sensitivity is fixed when the film is manufactured and whose image density can only be controlled by changing the exposure of an image or the amount of incident light or both.

SUMMARY OF THE INVENTION

A photographic film strip having images thereon is passed through a so-called flow type camera which runs an electrophotographic film parallel to the photographic film and at identical speed at the point of projection. The image from the photographic film is projected through a slit with the aid of a lamp and an optical system and is directed in such slit form against the photographic film with a one to one image ratio. The electrophotographic film is charged prior to exposure by suitable charging means whose charging level is controllable. Following the exposure means are provided to flood tone the latent image using a suspension of toner in a diluent. Excess toner is removed by a station which follows the toning station and may comprise a source of vacuum. The toned images are fixed by a suitable heat lamp or sealant following the toning.

The apparatus includes suitable supply and take-up spools, guide and tension rollers, drive means, speed controls and the like.

The photographic film is scanned prior to the projection of the image by a photocell or other photoresponsive device to obtain an electrical signal which is related to the background density. A reference signal is also produced in a suitable circuit which is representative of the desired standard, having been preset by proper choice of the circuit parameters. The electrical signal from the photoresponsive device and the fixed signal from the reference source are compared in electronic comparing means to derive a control signal representing the difference, if any, between the background density signal and the reference. This control signal is then utilized to change the charging circuit to produce the optimum level of surface charge for image enhancement or contrast control, as it may be called. The toner particles which are applied after exposure will adhere to a greater extent to the electrophotographic film whose surface charge is the greater so that the toned image has increased contrast over one which results from a lower surface charge, for example.

BRIEF DESCRIPTION OF THE DRAWING

The single FIGURE illustrates in diagrammatic form a system which embodies the invention and a block diagram used in explaining the automatic image enhancement control.

DESCRIPTION OF THE PREFERRED EMBODIMENT

The invention herein provides a method and apparatus for the continuous automatic duplication of original film on a much more economical electrophotographic film.

The original film is represented by the strip 10 and comprises for example, 35 millimeter silver halide film having a plurality of frames of different images along its length. Usually such images will be positives in that they can be projected for viewing in order to utilize the information contained thereon. As examples, the film may be cinematographic film, microfilm or a sequence of photographic stills. The duplicate film is preferably the type of electrophotographic film disclosed in the copending application and comprising a plastic film substrate having a sputtered coating of cadmium sulfide bonded thereto with an ohmic layer sandwiched between the cadmium sulfide coating and the substrate.

As explained in the copending application, the coating is a high speed, high gain, high resolution electrostatic material which is capable of unusual charge acceptance and is of variable sensitivity. It can be exposed with speeds comparable to those at which conventional photographic film can be exposed and it is considerably more economical than silver halide film because there is no silver in the film. Additionally, it is durable and abrasion resistant, is unaffected by moisture and most chemicals and has remarkable archival qualities since it is unaffected by fungus or long periods of storage in various atmospheres. The duplicate film is shown in the FIGURE as the strip 12.

The supply reel for the photographic film 10 is shown at 14 and its take-up reel at 16. The supply reel for the electrophotographic film 12 is shown at 18 and its take-up reel is shown at 20. The film speed drives and controls are not shown since these may be conventional in order to assure that the translative speed of both films at the exposure station 22 is the same. Various guide and tension rollers for controlling the movement of the film strips 10 and 12 are shown at 24 and their operation and construction are too well-known to require further description.

The direction of movement of the respective film strips is indicated by the arrows. The film strips move in opposite directions. The original film strip 10 comes off the supply reel 14, passes alongside of a photocell 26 which continuously responds to the background density of the framed images. A lamp 28 may be stationed below the film strip 10 to direct a beam of light through the image and onto the photocell 26. The emulsion on the surface of the film strip 10 preferably faces downward as at 10'. From the photocell 26 and lamp 28 (which together may be termed a background density measuring station 30) the film strip 10 passes to the projection station 32 which is located identically along the length of the both film strips 10 and 12 as the exposure station 22. Here there is an optical slit 34 which receives light from the lamp 36 projected through an optical system 38, part of which is above the film strip 10 and part of which may be below the strip 10. The film strip 10 is then wound up on the take-up reel 16.

Looking at the electrophotographic film strip 12, its photoconductive coating is disposed on its upper surface 12', that is, facing the emulsion surface 10'. Just prior to passing a slit 40 which guides the beam 44 from the projector 38, the photoconductive surface 12' is charged by the charging means 42. This may be a corona producing device of any suitable construction. The photoconductive surface of the film strip 12 is charged in darkness and as is the case with electrostatic members, it assumes a charge on its photoconductive coating or below the same which is capable of being discharged by photons represented by a light pattern.

Such pattern is provided by the beam of light 44 passing through the slit 40 (the apparatus being otherwise in complete darkness) and as a result, since the two film strips 10 and 12 are moving at the same speed, albeit in opposite directions the images from the photographic film 10 are laid down in a continuous flow fashion onto the electrophotographic film 12 as latent images. Immediately after passing the exposure station 22, the latent images pass into a toning station 46 at which the surface 12' of the film strip 12 receives a flood of liquid toner from dispenser 48 supplied from any suitable source. Immediately after the flooding of the surface by liquid toner the excess may be removed by a suction device 50.

The liquid toner may be of such type that the solvent evaporates quickly and the particles which do not adhere to the charged film fall or are brushed or are blown off the film. In any event, the function performed at the station 46 is toning. The film then passes to a fixing station 52 at which point a heat lamp 54 fuses the toner to the film surface 12'. The invention contemplates a type of toner which will adhere to the film without being fused by heat.

The completed duplicate film strip 12 is then wound up on the take-up reel 20.

Although not illustrated, means may be provided at the payout side of the reel 18 fully to discharge the photoconductive coating of the film 12. This could be an intense light, for example, for wiping off static charge picked up inadvertently.

It is known that the higher the surface potential to which an electrostatic member is charged, the greater the affinity for toner particles adhering thereto. This principle is used in the invention to achieve automatic image enhancement in the duplication of the images from the original to the electrophotographic film.

Thus, the signal from the photocell 26 at the station 30 is applied by the line 56 to one lower terminal 58 of a differential amplifier 60 whose upper terminal 62 derives a signal from a reference source 64. The reference signal source 64 is constructed to provide a fixed signal that has been adjusted by simple experimentation to represent a standard of image background density which provides the optimum of acuity for the duplicated image. Thus, signal source 64 may be a simple d.c. voltage source and a potentiometer calibrated in terms of background density. Bright images will produce more light in the beam 44 than dim images. The bright images will require less toning because they will result in greater discharge of the surface than the dim images. Since the toning supply is continuous and the time of toning is fixed, the control may be exerted by means of the surface charge, that is, by raising and lowering the charge potential.

A dark image passing little light should call for a higher charging potential than a bright image passing more light so that in the case of the dark image more toner will be caused to adhere. Accordingly, it is a simple matter to adjust the reference signal source 64 so that when the photocell 26 measures a background density which is average there will be no output from the differential amplifier 60 but when the background density is too bright there will be a decrease in the charge voltage; likewise when the background density is too dark there will be an increase in charge voltage.

The output of the differential amplifier 60 appears at 66 and is applied to the input of a charge voltage control circuit 68 controlling the power supply 70 to the charging means 42. The output from the control 68 passes to the charge means 42 by way of the line 72 which may have a delay circuit 74 to compensate for the time that it takes for the film location point of measurement of background intensity at station 30 to reach the charging station 42.

The control of toning by varying the charge voltage will provide the optimum contrast for the duplicated film 12 and in effect could provide higher quality, in some instances more information than retrievable from the original film by simple duplication.

It might be mentioned that the duplication proceeds according to the invention with the film strips 10 and 12 spaced apart as of necessity. This is in contrast with contact printing done in conventional duplicating processes. As a result there is better copying with greater depth of field; no scratching or transfer of dust; no flutter of film at high speed. Also prior processes had to be conducted in complete darkness, but in the invention herein only the charging, exposing, toning and fixing stations need be in darkness.

Variations are capable of being made without departing from the spirit or scope of the invention as defined in the appended claims.

What is claimed and desired to secure by Letters Patent of the United States is:

1. Apparatus for duplicating photographic images carried by an original strip film onto a flexible, transparent strip of electrophotographic film having a photoconductive, charge-acceptable coating which comprises:

A. supply and take-up means for each strip including structure for guiding and continuously moving the strips in opposite general directions, B. a projection and exposure station at which said guiding and moving means are arranged to pass the strips in parallel spaced juxtaposition at the identical speed, C. charging means disposed before the projection and exposure station and arranged to charge the coating of the electrophotographic film to a predetermined surface potential in darkness, D. the projection and exposure station including a source of light and projector means for projecting a narrow transverse area of said original strip film directly, continuously and uninterruptedly onto the coating of said electrophotographic film as the two strips move, and the strips being disposed such that when so moved parallel, the coating will face the strip film, the projection serving to form a duplicate of the images of the original film as latent charge images on the electrophotographic film, and E. a toning station located after the projection and exposure station and including means for continuously flood toning the latent charge images with liquid toner to render the same visible forming a duplicate-original of said original strip film.

2. The apparatus as claimed in claim 1 in which the toning means include means for withdrawing excess toner from said electrophotographic film after said toning.

3. The apparatus as claimed in claim 1 in which a toner fixing station is located after the toning station having means thereat to fix the toned images.

4. The apparatus as claimed in claim 1 in which means are provided to vary the degree of charge produced by said charging means to adjust the contrast of the duplicate images.

5. The apparatus as claimed in claim 1 in which means are provided for varying the degree of charge produced by said charging means in response to variations of the background density of the original images in order to adjust the contrast of the duplicate images.

6. Apparatus for duplicating photographic images carried by an original strip film onto a strip of electrophotographic film having a photoconductive, charge-acceptable coating which comprises:

A. supply and take-up means for each strip including structure for guiding and moving the strips in opposite general directions, B. a projection and exposure station at which said guiding and moving means are arranged to pass the strips in parallel spaced juxtaposition at the identical speed, C. charging means disposed before the projection and exposure station and arranged to charge the coating of the electrophotographic film to a predetermined surface potential in darkness, D. the projection and exposure station including a source of light and projector means for projecting a narrow transverse area of said original strip film continuously onto the coating of said electrophotographic film as the two strips move, the projection serving to duplicate the images of the original film as latent charge images on the electrophotographic film, E. a toning station located after the projection and exposure station and including means for continuously flood toning the latent charge images with liquid toner to render the same visible, F. means disposed prior to the projection and exposure station to measure the background density of the images on said original film passing to said projection and exposure station and deriving a signal responsive to said background density, G. a source of reference signal for producing a reference signal representative of the desired background density, H. means for comparing the two signals and deriving therefrom a third signal representing the difference, if any, I. control means for varying the voltage level of said charging means, and J. the comparing means being coupled to the control means to vary the degree of charge of said photoconductive coating in accordance with said background density.

7. The apparatus as claimed in claim 6 in which means are provided to synchronize the appearance at the projection and exposure station of the image whose background density has been measured with the occurrence of the area of photoconductive coating which has been charged as a result of such measurement.

8. The apparatus as claimed in claim 6 in which the measuring means comprise a photoresponsive device, the comparing means is a differential amplifier and the photoresponsive device and reference signal source are coupled to respective input terminals of said differential amplifier.

9. In an electrostatic reproducing apparatus for reproducing strip film identically on a continuously moving electrophotographic member and which includes means to move the strip film and member in opposite directions relative to one another and relative to a projection and exposure station which projects the images from the strip film onto the member, charging means for charging the member to a certain degree of charge before it moves to said projection and exposure station and means for toning the member after the projected image passes the said projection and exposure station, the invention herein which comprises:

A. means located relative to the strip film and prior to its entering the projection and exposure station for measuring the background density of the images on the original strip film and deriving a first signal responsive to said background density, B. a source of reference signal is provided for producing a reference signal representative of the desired background density and comprising a second signal, C. means are provided for comparing the first and second signals and deriving therefrom a third signal representing the difference, if any, D. control means are provided for varying the degree of charge of the member as provided by the charging means through varying the voltage applied to the charging means, and E. the comparing means are coupled to the control means to vary the degree of charge of the member in accordance with the background density.

10. The invention as claimed in claim 9 and in combination therewith, means to synchronize the appearance at the projection and exposure station of the image whose background density has been measured with the occurrence of the area of the electrophotographic member which has been charged as a result of such measurement.

11. The invention as claimed in claim 9 in which the measuring means comprise a photoresponsive device, the comparing means are a differential amplifier, there is a light source adapted to be associated with the projection and exposure station, and the photoresponsive device and reference signal source are coupled to respective input terminals of said differential amplifier.

* * * * *